US005884798A

United States Patent [19]

Mock et al.

[11] Patent Number: 5,884,798

[45] **Date of Patent: *Mar. 23, 1999**

[54] CONTAINER INCLUDING MAIN BODY AND CLOSURE PART FORMED AS ONE PIECE FROM SAME MATERIAL AT SAME TIME

[75] Inventors: Elmar Mock, Biel; Marcel Aeschlimann, Welschenrohr, both of Switzerland

[73] Assignee: Tetra Laval Holdings & Finance S.A., Pully, Switzerland

[ * ] Notice: The term of this patent shall not extend beyond the expiration date of Pat. No. 5,372,284.

[21] Appl. No.: 603,404

[22] PCT Filed: Jun. 30, 1993

[86] PCT No.: PCT/CH93/00166

§ 371 Date: Mar. 3, 1994

§ 102(e) Date: Mar. 3, 1994

[87] PCT Pub. No.: WO94/01338

PCT Pub. Date: Jan. 20, 1994

Related U.S. Application Data

[63] Continuation of Ser. No. 199,253, Mar. 3, 1994, abandoned.

[30] Foreign Application Priority Data

Jul. 7, 1992 [CH] Switzerland ..... 02 140/92-3

[51] Int. Cl.[6] ..... B65D 43/14

[52] U.S. Cl. ..... 220/339; 220/DIG. 11; 220/DIG. 12; 264/524

[58] Field of Search ..... 220/339, DIG. 11, 220/DIG. 12; 210/364; 264/524, 525

[56] References Cited

U.S. PATENT DOCUMENTS

| | | | |
|---|---|---|---|
| 3,902,617 | 9/1975 | Valyi | 215/2 |
| 4,066,190 | 1/1978 | Chlystun . | |
| 4,082,827 | 4/1978 | Chlystun . | |
| 4,260,065 | 4/1981 | van Cromvoirt | 215/2 |
| 4,268,336 | 5/1981 | Piltz et al. | 264/524 |
| 4,344,545 | 8/1982 | Aschberger et al. | 220/339 |
| 4,380,525 | 4/1983 | Jakobsen et al. | 264/521 |
| 4,403,712 | 9/1983 | Wiesinger . | |
| 4,410,096 | 10/1983 | Paradis . | |
| 4,475,655 | 10/1984 | Andersson et al. | 229/207 |
| 4,650,088 | 3/1987 | Hirota et al. | 220/359 |
| 4,735,335 | 4/1988 | Torterotot | 220/359 |
| 4,754,896 | 7/1988 | Roltgen et al. . | |
| 4,830,273 | 5/1989 | Kalberer et al | 220/359 |
| 4,892,217 | 1/1990 | Shastal | 220/339 |
| 5,372,284 | 12/1994 | Mock | 222/153 |
| 5,381,935 | 1/1995 | Mock | 222/541 |
| 5,413,238 | 5/1995 | Mock | 220/339 X |

FOREIGN PATENT DOCUMENTS

| | | |
|---|---|---|
| 0 079 676 | 5/1983 | European Pat. Off. . |
| 29 47 544 | 6/1981 | Germany . |
| WO-A-82/02532 | 8/1982 | WIPO . |

*Primary Examiner*—Joseph M. Moy
*Attorney, Agent, or Firm*—Frishauf, Holtz, Goodman, Langer & Chick

[57] ABSTRACT

The invention relates to a container made from a material, which is shaped in the fluid state and hardened to a given shape and which is provided for receiving a product or article and has a closure part (4). To simplify the manufacture of the container, the closure part is placed over at least one container wall (1) and is shaped from one piece therewith, so that the closure part is inseparably arranged on the container and is movable in order to remove the content. The container and the closure part are made from the same material.

7 Claims, 8 Drawing Sheets

FIG. 2
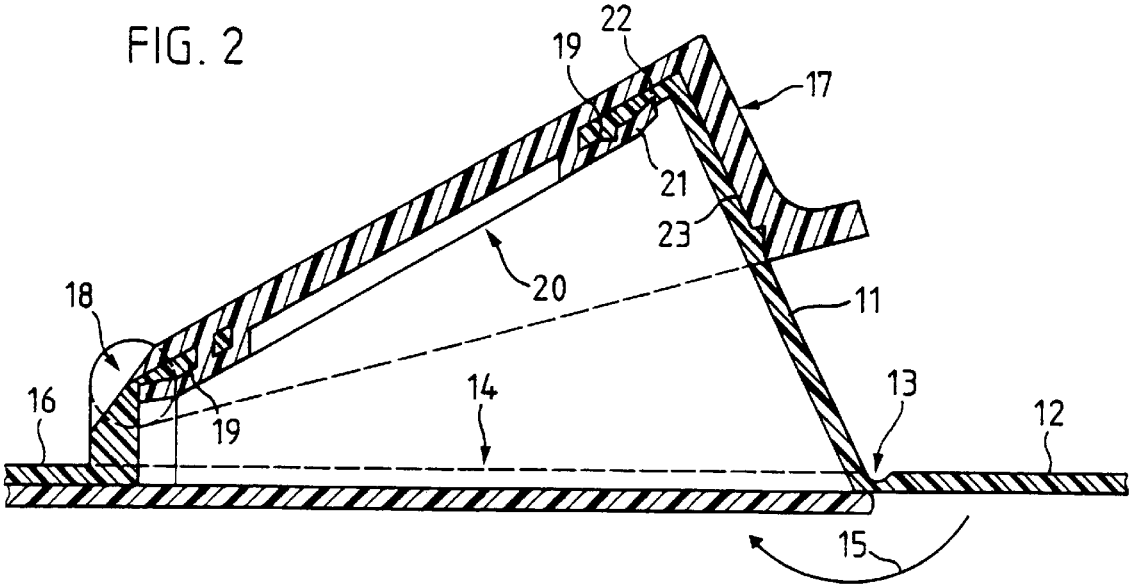
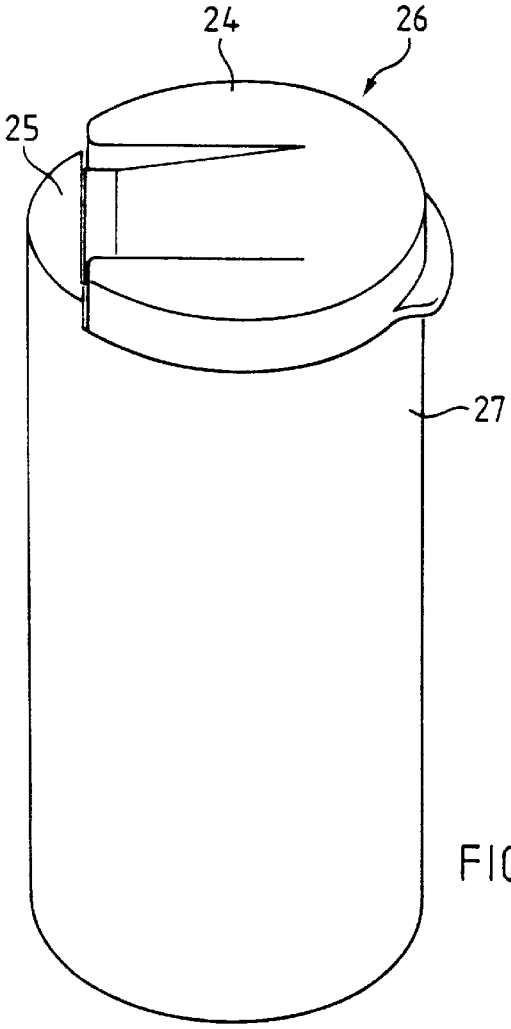
FIG. 3

CONTAINER INCLUDING MAIN BODY AND CLOSURE PART FORMED AS ONE PIECE FROM SAME MATERIAL AT SAME TIME

This application is a Continuation of application Ser. No. 08/199,253, filed Mar. 3, 1994 now abandoned.

BACKGROUND OF THE INVENTION

The invention relates to a container made from a material, which is shaped in a fluid state and hardened to a given shape and which is provided with a closure part.

Numerous different constructions of such containers are known. A first construction is e.g. in the form of a glass bottle with a screw-on plastic cap. A second construction is in the form of a plastic receptacle with a screwed or fitted on closure. First and second variants with respect to each of these two constructions are known. In the first variant the closure is completely removed, by unscrewing to remove a product. In the second variant the closure is made from two parts, whereof one is opened or removed in order to be able to extract the product from the container, whereas the second remains fastened to the container. In both cases the product is filled or inserted into and then removed from the container by means of the same opening. In the case of such containers, the container and the closure unit are in each case separately manufactured, because the container and the closure unit are never made from exactly the same material and because the shapes of the two parts differ too greatly from one another.

The disadvantage of such known constructions is that for an intended use, in order to store a product having specific chemical properties, it is necessary to choose two materials, which on the one hand both have to satisfy the conditions for the product, but which on the other must also match one another. In addition, for the containers in said known variants, the actual container and the closure part must be separately manufactured using different processes. This can mean that the places where the two parts are manufactured can be far apart. This can lead to organizational problems and can lead to the location where the containers are filled having to keep stores of both parts, so that before or after the filling of the product into the container both parts can with certainty be brought together and thereby seal the container. A further disadvantage of such containers is that it is very difficult to perform a sealing function in the case of such closure units, where a product or an article must be inserted and removed through the same opening. As in the known variants the filling opening and the pouring or removal opening coincide, a compromise must be reached in the design thereof. This compromise takes account of the requirements existing on filling, such as a large cross-section in order to achieve a high flow rate or so as to be able to remove articles having large dimensions and at the same time takes account of requirements made in connection with the removal of the product, such as small openings due to the rapid evaporation of the product, etc. Thus, this known construction of containers with closure units leads to the manufacture of the container and the closure unit occurring in parallel in a first stage in each case followed by a second stage during which the product is filled or inserted in the container and finally in a third stage in which the closure unit is fixed to the container.

SUMMARY OF THE INVENTION

The present invention solves the problem of providing a container with a closure unit, which is simpler and more economic and has characteristics which can be adapted in optimum manner to the requirements defined by the properties of the product or the inserted article. A further problem of the invention is to provide a process for the production of such a container, which is economic and which can be advantageously linked with the process of filling a product or article into the container. Yet another problem of the invention is to provide a sealing function on the closure part.

According to the invention the set problem is solved in that the container with the closure part is essentially produced in one piece from a single material and in a single operation. Thus, for example the container as such and a closure part are together constructed in one piece and preferably manufactured in the closed state. This includes a hinge by means of which the closure part is movably fixed to the container. A filling or insertion opening is left open in the container and is only closed following the filling of the product or the insertion of an article. Thus, the possibility exists of constructing and manufacturing the closure part together with a portion of the container as a semifinished product. Subsequently, i.e. with or shortly before the filling of the product, the container can be further constructed and enlarged.

Thus, the invention makes it possible to construct from the closure part a container and thereby unite the container with the closure part both constructionally and from the manufacturing standpoint. The basis is the more complicated part, namely the closure part and on it is formed the container part, which is usually much less demanding. This is particularly advantageous if high demands are made on the closure part, which lead to a relatively complicated shape thereof. In this case it is particularly advantageous to be able to obviate measures for fixing the closure part to the container. This leads to further design freedom, which is advantageous for the closure part and ultimately increases the value of the container as a whole. As the manufacture of the entire container can take place from one material and in one step, it is easier to integrate into the manufacturing process the filling of the product.

It is only necessary to choose a single material for the container and the closure, which is compatible with the product. As a result of the invention it is now possible to manufacture the container with the closure part and fill the product in a single plant, to which it is only necessary to supply materials for the container, a well as the product or similar articles. The plant can be constructed in such a way that it brings the product and the material in an arrangement which is advantageous for the storing and handling of the product. As in this way it is possible to provide closure parts, in which the closure part and container are interconnected in one piece prior to the initial opening of the closure part, the entire area around the closure unit can be kept absolutely tight, so that without difficulty the product can be isolated against the environment for a longer period of time without any further measures, so that product aging is avoided.

BRIEF DESCRIPTION OF THE DRAWINGS

The invention is described in greater detail hereinafter relative to a non-limitative embodiment and the attached drawings, wherein:

FIGS. 1 and 2 show in each case a container according to the invention in section.

FIG. 3 shows a view of the container.

DESCRIPTION OF THE PREFERRED EMBODIMENTS

Figure 1:
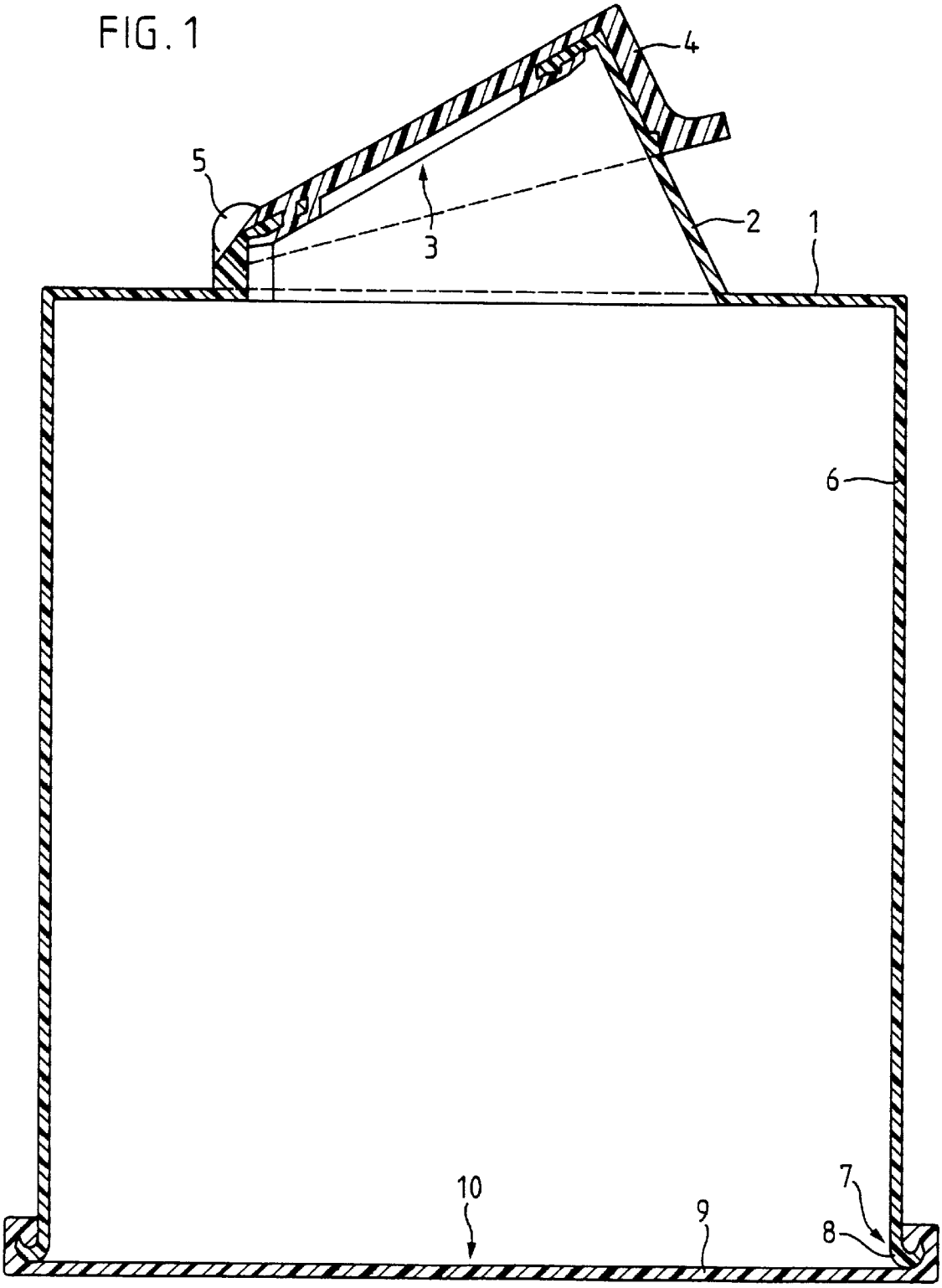

FIG. 1 shows the container according to the invention with a top container wall 1 issuing into a pouring part 2. The latter forms a pouring opening, which is closed by a closure part 4. By means of a hinge 5 the closure part is placed in fixed and movable states in a hinged manner on the pouring part 2. A further cylindrical wall 6 is connected to the container wall 1 or passes out of the same. At the end 7 remote from the container wall 1, the wall 6 passes into an edge 8, which is provided for fixing a lid cover 9. The lid or cover 9 consequently closes a filling opening 10 and can be connected in fixed or removable manner to the edge 8.

FIG. 2 shows a second embodiment of a container, in which the pouring part coincides with or actually forms the container wall 11. The container wall 11 passes downwards into a lid 12, which is connected to the wall 11 by means of an easily bendable point 13. The lid 12 has a shape, which so matches a filling opening 14 in the container that the lid 12 can be made to close the filling opening 14 by pivoting in the direction of an arrow 15. By means of a projecting edge 16, the lid 12 can then be connected to the container, e.g. by adhesion or welding, in such a way that the filling opening is tightly sealed. The edge 16 is present to such an extent on the circumference of the filling opening that the latter is not stressed or covered by the bendable point 13. Once closed, said filling opening cannot be opened again, except by destroying or damaging the lid 12, so that the latter cannot be closed again. There is also a closure part 17, which is fixed by means of a hinge 18 to the pouring part or container wall 11. It is also clear that the closure part 17 is made from two materials. A first material 19 from which is also made the pouring part or container wall 11, passes from the latter and over and beyond the hinge 18 into the closure part 17, so that a so-called film hinge is formed. In the vicinity of a pouring or removing opening 20 the first material 19 is surrounded by a second material 21. At a point 22 the first material 19 forms a predetermined breaking point, which is destroyed on the initial opening of the closure part 17 under the pressure of the second material 21. Between the pouring part and the closure part 17 there are also sealing faces 23, which in the closed state seal these two parts against one another.

FIG. 3 shows a container with a closure unit 26, which comprises a closure part 24, here shown in the closed state, and a pouring part 25, which forms part of a container wall 27.

Figure 4:
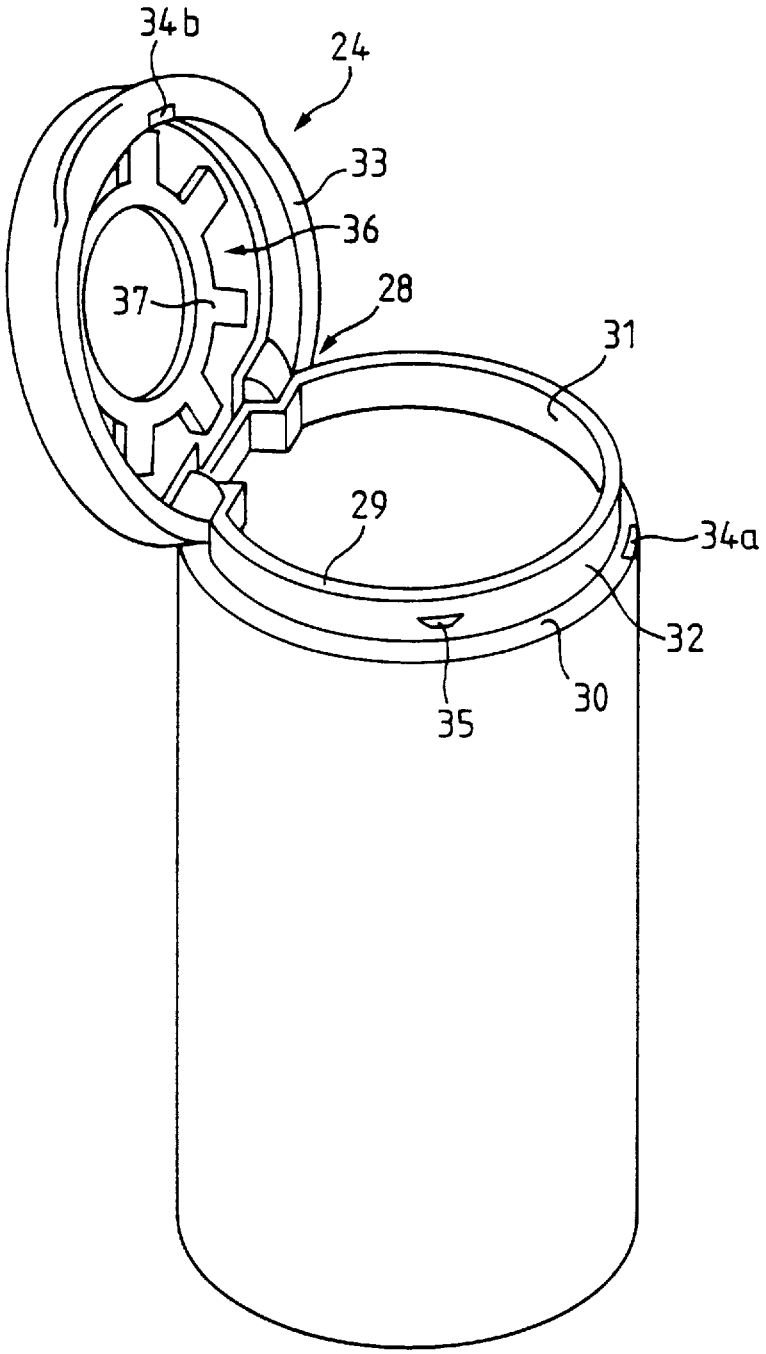
FIG. 4 shows a container with the closure part open.

FIG. 4 shows a container similar to that of FIG. 3. It is shown here with an open closure part 24. It is also possible to see a hinge 28, having a construction such as is known from Swiss patent application 3681/91-2 corresponding to U.S. Pat. No. 5,381,935, together with various sealing faces 29, 30, 31, 32, 33 and a predetermined breaking point 34*a*, 34*b*, which is destroyed on the first opening and therefore shows whether the closure part has already been opened. A cam 35 is used for the positive fixing of the closure part 24 to the container in the case of multiple opening and closing. In the closure part 24 there is once again an area 36 made from a second material, which can have different characteristics from the material in an area 37 and in the remaining container, such as a different colour. Such a container can be used for a fluid product, as well as for a single article, such as a roll of film. The latter could be introduced by means of a not shown opening in the container bottom. This opening is then closed in such a way that it cannot be reopened, unless the roll of film is removed by the user through the opening covered by the closure part 24. By means of said opening it can also be returned into the container when the film has been exposed and the container protects the roll of film on its way to the photographic laboratory. Thus, it is possible to see from the predetermined breaking point 34*a*, 34*b* whether the film has already been removed once from the container.

Figure 6:
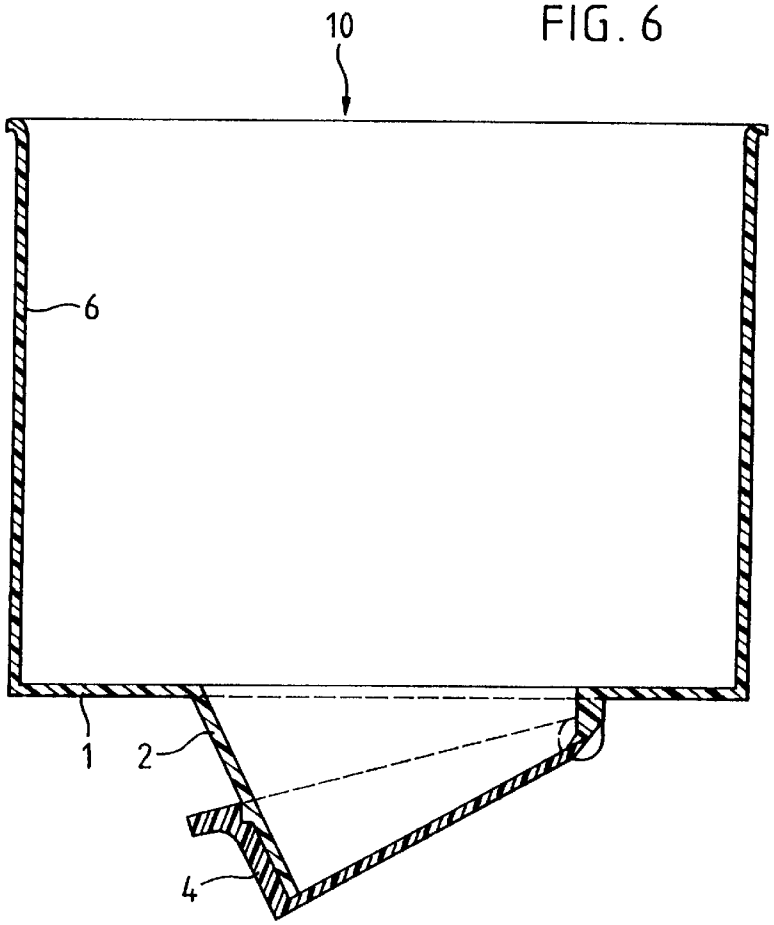
FIGS. 5, 6, 7 and 8 show in each case stages in a process for the production of the container, for filling the product or inserting an article and for closing the container.
Figure 5:
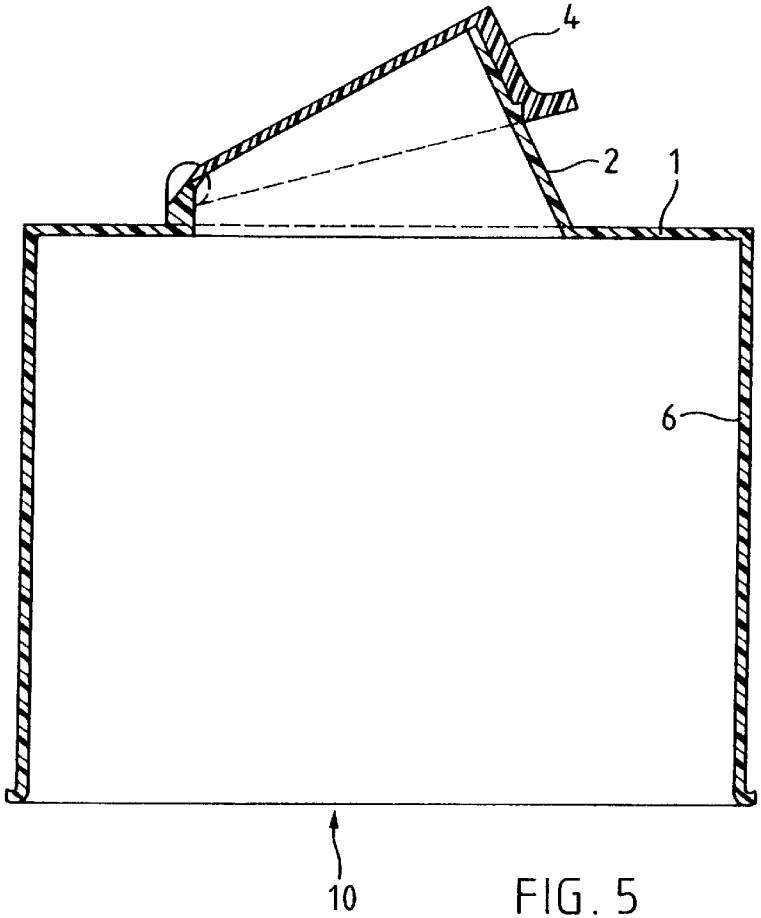
Figure 8:
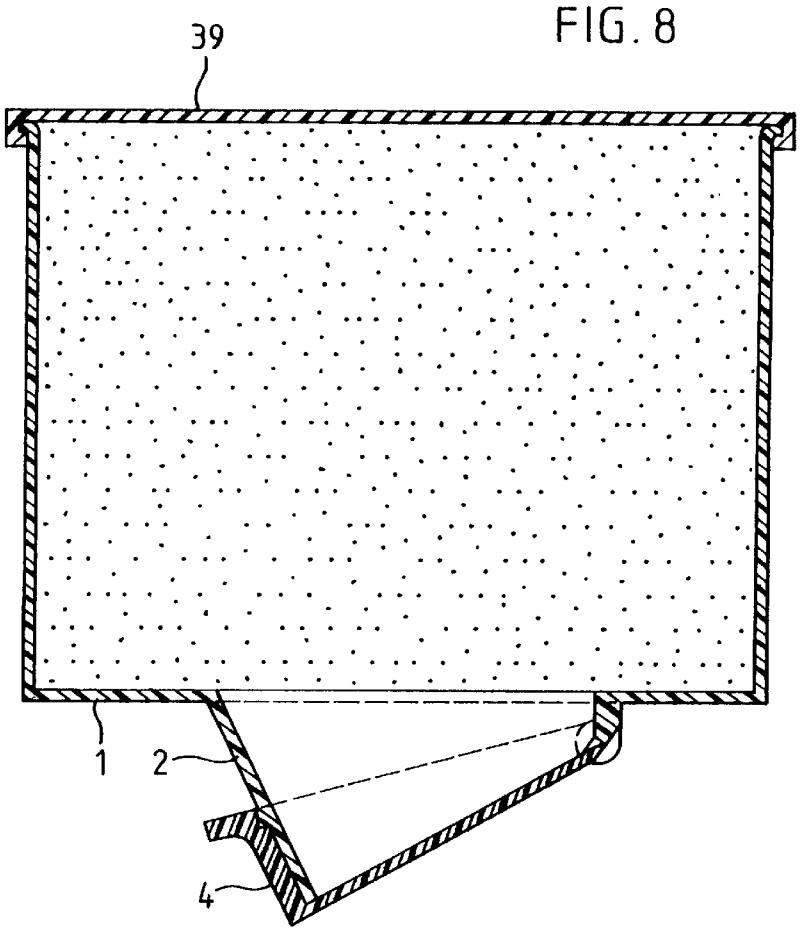
Figure 7:
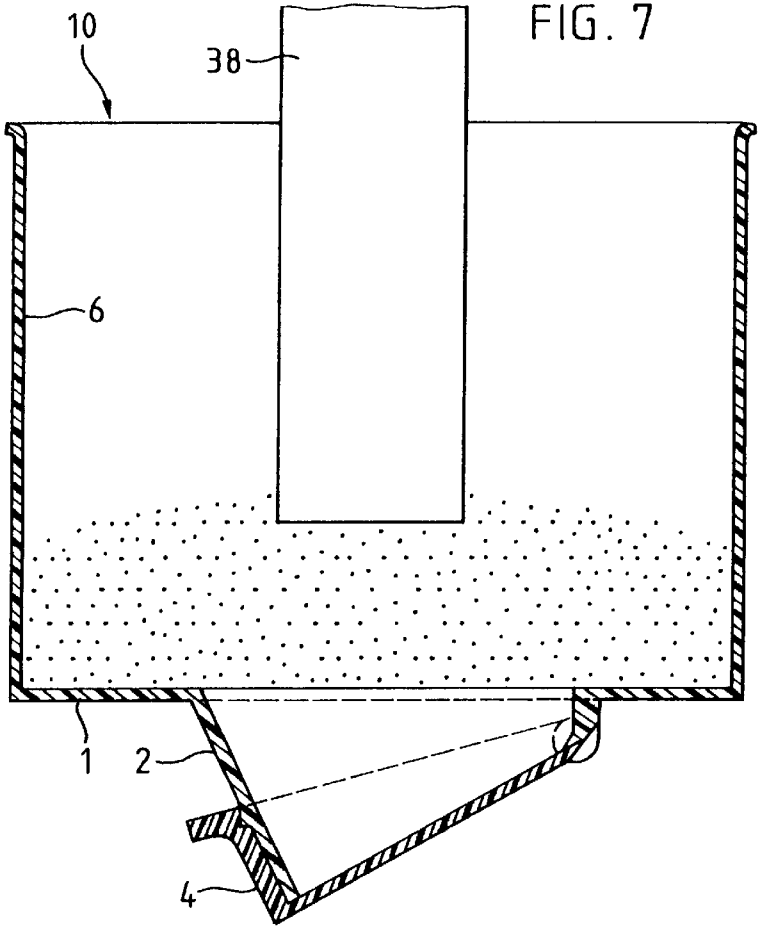

FIG. 5 shows a first step in the manufacture of a container according to the invention. The starting product is constituted by the closure part, as described in Swiss patent applications 2739/91-2 and 2740/91-9, corresponding to U.S. patent application Ser. No. 08/050,417 and which is produced by injection moulding. However, in this case the mould used has been extended to such an extent that in addition to the moulding of the wall 1, the pouring part 2 and the closure part 4, as known from the above applications, moulding also takes place of the container wall 6 with the filling or insertion opening 10. The container is then removed from the mould and brought into a position, as shown in FIG. 6 and in which it is possible to fill or insert the product. This filling or insertion stage is shown in FIG. 7, in which a filling device 38 is inserted in the filling opening 10. In a further step according to FIG. 8, the filling opening 10 is closed, in this case by a lid 39.

Figure 9:
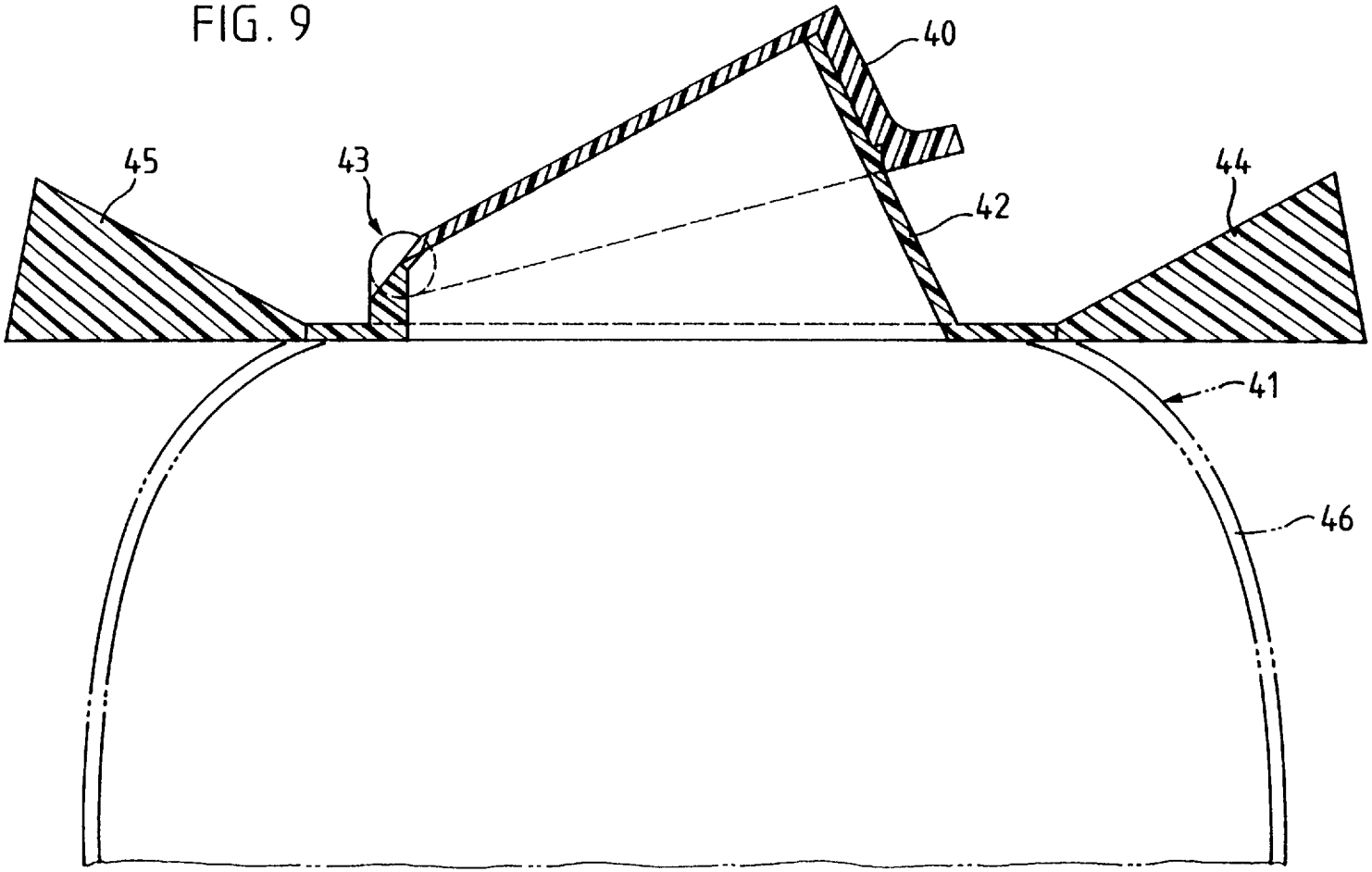
FIG. 9 shows a further container with steps for its manufacture.

FIG. 9 show s another embodiment of a container according to the invention and a further possibility for its manufacture. In known manner the container comprises a closure part 40, which is connected to the pouring part 42 or the container 41 by means of a hinge 43, such as is known from Swiss patent application 3682/91-4 corresponding to U.S. Pat. No. 5,381,935. The closure part 40 and the pouring part 42 are made from the same material. However, firstly the closure part 40 and then the pouring part 42 is moulded thereon and a hinge 43 is formed. During the moulding of the pouring part 42, i.e. during the second moulding stage, moulding also takes place of a continuous extension, shown in cross-section by extensions or pockets 44, 45 from which it is subsequently possible to produce the container wall 46 by deep drawing. The closure part 40 and pouring part 42 with the pockets 44, 45 forms a semifinished product, which can be intermediately stored or transported, which takes up relatively little space and which can be subsequently moulded into a container just prior to the filling of the product. Thus, from such a semifinished product it is possible to produce containers with completely different shapes. The decision concerning the final shaping can consequently also take place after a time delay.

Figure 10B:
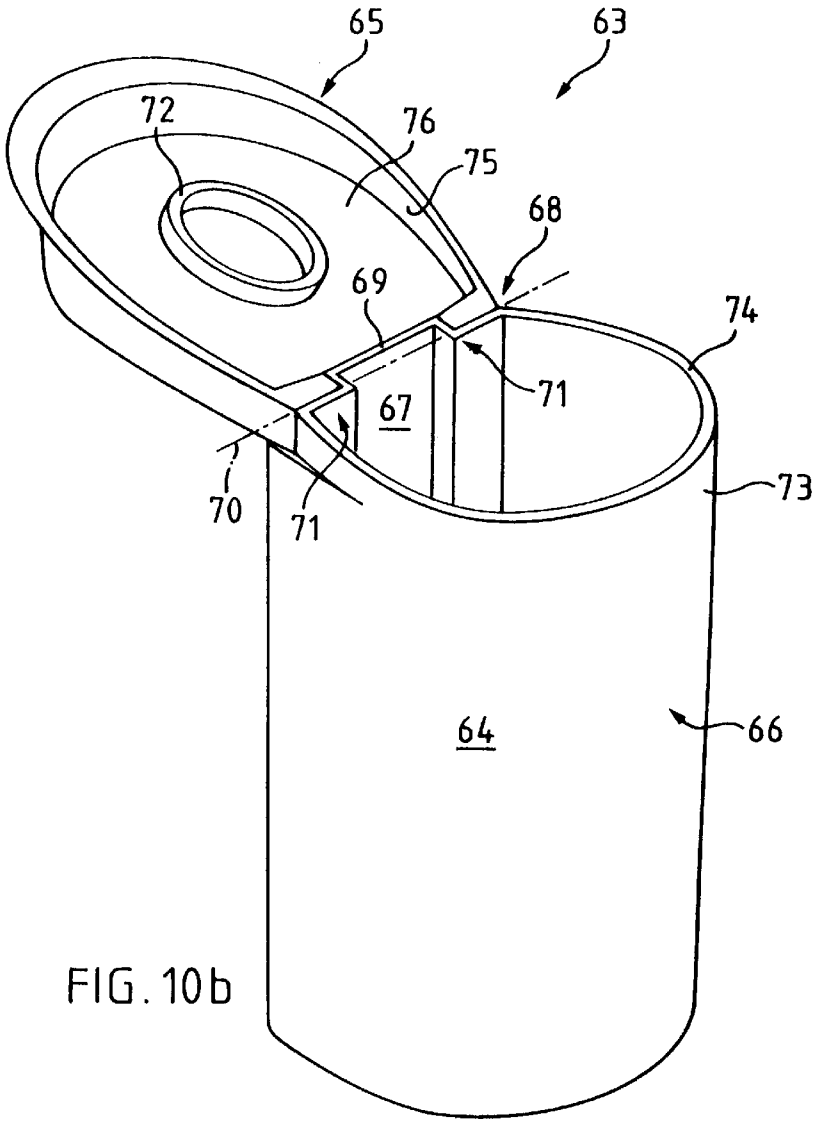
FIGS. 10*a* and 10*b* show a further container with a closed and opened closure.
Figure 10A:
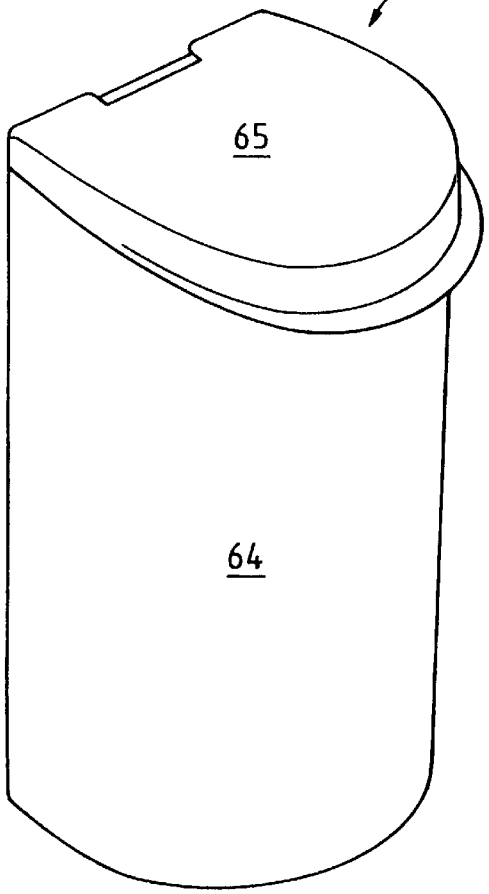

FIG. 10*a* shows a container 63 according to a further embodiment. The container 63 comprises the actual container body 64 and a closure 65. FIG. 10*b* shows that with the closure 65 open, the container body 64 comprises a curved front wall 66 and a straight rear wall 67. The closure 65 is e.g. connected to the container body 64 by means of a combined hinge 68, which is on the one hand formed by a web or a film 69 connecting the rear wall 67 to the closure 65 and on the other by not shown joints 71 located in an axis 70. In the closure 65 is additionally moulded a circular element 72, which e.g. centers the content when the closure 65 is closed. When the closure 65 is closed, it overlaps with the upper edge 73 in such a way that the latter at this point and at its end face 74 form sealing surfaces, whose corresponding countersurfaces 75 and 76 are located in the closure 65.

Figure 11A:
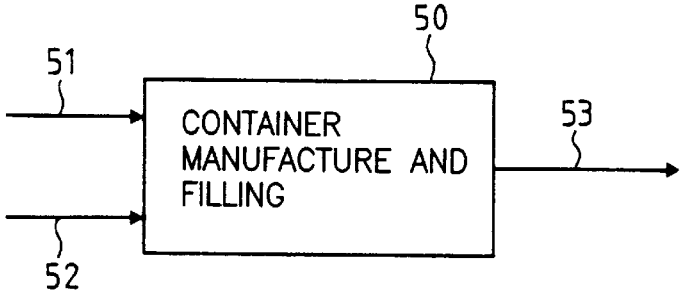
FIGS. 11*a* and 11*b* show in each case a block diagram of the process steps, for producing and filling a container.

FIG. 11*a* shows in block diagram for the process for the production of the container and for the filling of the product or the insertion of an article in the container. The block 50 represents a plant for the manufacture of containers and for filling or inserting products. To this plant represented by block 50 is supplied the container material by means of an inlet 51 and the product or articles by means of an inlet 52. In said plant the containers are manufactured and filled in known manner and by means of an outlet 53 the plant represent by block 50 discharges filled and closed containers.

Figure 11B:
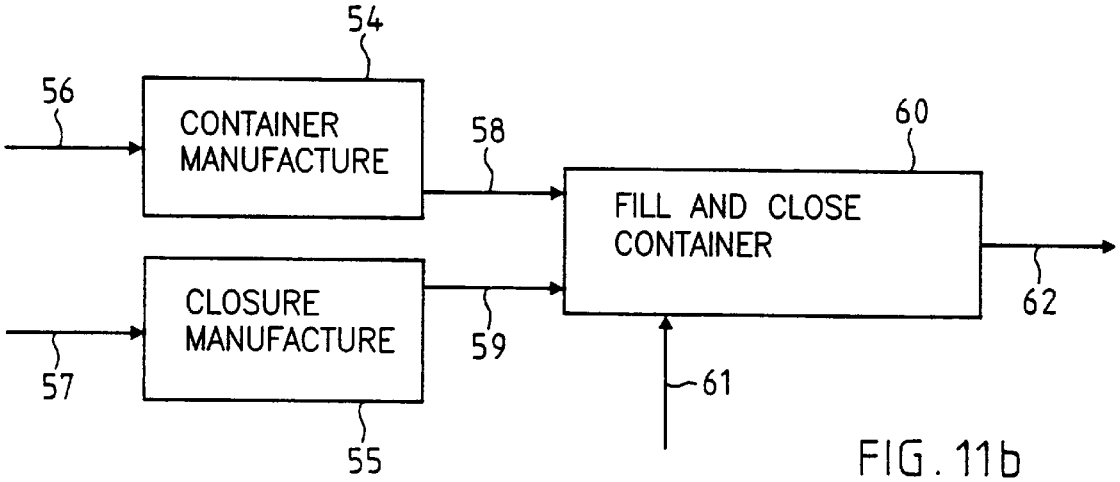

As opposed to this, FIG. 11*b* shows a prior art process. For this purpose it is necessary to have a plant 54 for the manufacture of unclosed containers, as well as a plant 55 for the manufacture of closures, which receive container material and closure material by means of the inlets 56 and 57. These plants 54 and 55 supply the containers and closures separately by means of the outlets 58 and 59 to a plant 60 for filling and closing the containers. The plant 60 is supplied with the product or articles by means of a further inlet 61. The plant 60 discharges filled and closed containers by means of an outlet 62. A comparison of FIGS. 11*a* and 11*b* shows that the process according to the invention is simpler, because there is no need for the independent plants 54 and 55. The manufacture of the containers and the filling of the product can now be performed in an integrated plant. Thus, there is no need for the connections, transportation paths, intermediate stores, etc. connected to the outlets 58 and 59.

Therefore the invention relates to containers intended for a product or for a single article. The product or article can be tipped out of the container or can be removed by means of a tool, such as e.g. a spoon or tweezers.

We claim:

1. A container formed by injection molding, the container comprising;

a container body having a pouring opening, a filling opening, and a container wall molded as a single piece with a pouring part from a same first material; and a closure part hingedly connected to said pouring part, said closure part being formed from a second material different from said first material;

wherein said pouring part and said closure part are molded onto one another such that sealing faces are formed between contacting portions of the first material of the pouring part and the second material of the closure part, and said closure part and said pouring part are formed in a closed state so as to close said pouring opening;

wherein said pouring part extends inside said closure part and includes a predetermined breaking point formed inside said closure part such that the breaking point is protected by the closure part and is not exposed to external influences; and wherein said pouring part is broken at the breaking point upon an initial opening of said closure part.

2. The container according to claim 1, wherein said closure part and said pouring part have sealing faces which engage each other for tightly closing said pouring opening.

3. The container according to claim 1, further comprising a lid for closing said filling opening, said lid being connected to said container body after said container is filled with a product such that the filling opening can only be opened by destroying said lid.

4. A semifinished product for producing a container according to claim 1, wherein a thickened extension is formed from said first material next to said pouring part, said thickened extension being shapable into said container wall.

5. A method of making the container of claim 2, comprising:

molding said closure part from said second material;

forming said pouring part and said container wall as said single piece such that said closure part and said pouring part are molded as one piece in a closed state with said sealing faces of said closure part and said pouring part engaging each other and tightly closing said pouring opening.

6. The method according to claim 5, further comprising the steps of filling a product into said container through said filling opening and subsequently closing said filling opening to close said container.

7. The method according to claim 5, wherein said forming step comprises:

providing said first material in an unshaped state as an extension portion of said pouring part; and subsequently forming said container wall from said extension portion.

* * * * *

UNITED STATES PATENT AND TRADEMARK OFFICE

CERTIFICATE OF CORRECTION

PATENT NO. : 5,884,798
DATED : March 23, 1999
INVENTOR(S) : Mock et al.

It is certified that error appears in the above-identified patent and that said Letters Patent is hereby corrected as shown below:

Title page,
Item [56], References Cited,
Under "FOREIGN PATENT DOCUMENTS", insert

| | | |
|---|---|---|
| -- AU 49448/59 | 6/1959 | AUSTRALIA |
| AU 80459/82 | 6/1982 | AUSTRALIA |
| AU 82600/87 | 7/1989 | AUSTRALIA |
| AU 44338/89 | 5/1990 | AUSTRALIA |
| AU 80937/89 | 2/1992 | AUSTRALIA --. |

Signed and Sealed this

Eleventh Day of December, 2001

*Attest:*

Nicholas P. Godici

*Attesting Officer*

NICHOLAS P. GODICI
*Acting Director of the United States Patent and Trademark Office*